United States Patent [19]

Haeusslein et al.

[11] Patent Number: 4,970,355

[45] Date of Patent: Nov. 13, 1990

[54] SAFETY DEVICE IN AN ELECTRICALLY POWERED MACHINE, ESPECIALLY A HAND-HELD POWER TOOL

[75] Inventors: Friedrich Haeusslein; Manfred Staebler, both of Leinfelden-Echterdingen, Fed. Rep. of Germany

[73] Assignee: Robert Bosch GmbH, Stuttgard, Fed. Rep. of Germany

[21] Appl. No.: 377,702

[22] Filed: Jul. 10, 1989

[30] Foreign Application Priority Data

Jul. 28, 1988 [DE] Fed. Rep. of Germany ..... 3825654

[51] Int. Cl.[5] ..... H01H 9/20

[52] U.S. Cl. ..... 200/50 B

[58] Field of Search ..... 200/50 R, 50 B, 61.85 R, 200/61.85, 318, 318.1, 318.2, 293.1

[56] References Cited

U.S. PATENT DOCUMENTS

| | | | |
|---|---|---|---|
| 3,212,938 | 10/1965 | Neuhardt et al. | 200/50 B X |
| 3,881,081 | 4/1975 | Schilling et al. | 200/318.1 X |
| 4,280,026 | 7/1981 | Alessio | 200/321 X |
| 4,335,286 | 6/1982 | Nelson | 200/50 B X |
| 4,604,505 | 8/1986 | Henninger | 200/50 B |

*Primary Examiner*—J. R. Scott

*Attorney, Agent, or Firm*—Michael J. Striker

[57] ABSTRACT

The electrically powered machine, especially a hand-held power tool, comprises a housing, a cord to supply electrical energy, a switch changable between an "on" and an "off" position, a switch handle for operating the switch to control delivery of the electrical energy and a socket mechanism, which comprises a socket attached to a cord and a plug attached rigidly with the housing. A stop pawl is which prevents the connection of the socket to the plug in the machine, when and as long as the on-off switch is in the "on" position, thus preventing an unintentional start-up.

11 Claims, 1 Drawing Sheet

SAFETY DEVICE IN AN ELECTRICALLY POWERED MACHINE, ESPECIALLY A HAND-HELD POWER TOOL

THE BACKGROUND OF THE INVENTION

Our invention relates to a safety mechanism for an electrically powered machine, especially a hand-held power tool such as a drill or angle sander. It also relates to a stationary electrically powered machine such as a household appliance, which has a plug mechanism (e.g. according to DIN VDE 0625 Teil 1/11 87, Seiten 11, 12 und 59 or DIN German Society of Engineers 0625, Part 1, November 1987, pp. 11, 12 and 59) with a separate socket attached to a cord or power cable disconnectable from the appliance or machine and a plug built into the appliance.

Cords or cables are currently predominantly connected nonreleasably (i.e. the cord cannot be disconnected from the tool) with a power tool, although a hand-held power tool with the above-mentioned plug mechanism has a separable detachable power cord. This current structure has several disadvantages. The fixed attachment of the cord produces a bendable, slack part protruding from the outer surface of the appliance or hand-held power tool, which makes automatic manufacture particularly difficult. Among other things in different countries in which these machines are used different incompatible power grids are customary. This forces the manufacturer to market different machines according to the differences in the power grids in the different countries or to supply the machines without plugs and to place the responsibility of providing them on the customer.

Furthermore these nondisconnectable cables or power cords are prone to wear particularly in rough operating conditions; a worn-through or scraped cord attached nondisconnectably to the hand-held power tool can only be replaced by comparatively time-consuming methods.

One solution of this problem was to equip the machine with the above-mentioned separate cord with attached socket. This however results in a dangerous condition which might lead to injury: If the socket is again connected with the plug built into the unit, e.g. in an angle grinder, after a tool change and the switch of the power tool is in the "on" position, the angle grinder can tear the hand of the operator because of the starting moment. This situation can easily occur, because in tool changing the machine is disconnected by pulling the socket out and a switch inadvertently pressed in during tool changing is often not noticed.

SUMMARY OF THE INVENTION

Accordingly, it is an object of the present invention to provide a safety mechanism for an electrically powered machine, especially a hand-held power tool, having a separate disconnectable cord or cable for providing electrical power to the machine, which prevents inadvertent operation of the machine, when the cord is connected to the machine.

It is also an object of the present invention to provide a safety mechanism for an electrically powered machine, especially a hand-held power tool, having an "on"/"off" switch lockable in an "on" position, which is supplied power by a disconnectable cord or cable with an attached socket, the socket being connectable with a plug permanently attached to the housing of the machine which is electrically connected with the "on"/"off" switch, said safety mechanism preventing the socket from being connected with the plug, when the switch of the machine is inadvertently in the "on" position with the power cord disconnected.

It is another object of the present invention to provide a safety mechanism for an electrically powered machine, especially a hand-held power tool, having an "on"/"off" switch lockable in an "on" position, which is supplied power by a disconnectable cord or cable with an attached socket, the socket being connectable with a plug permanently attached to the housing of the machine which is electrically connected with the "on"/"off" switch, said safety mechanism preventing the socket from being connected with the plug when the switch of the machine is inadvertently in the "on" position with the cord or cable disconnected and also preventing inadvertent disconnecting of the cord or cable from the machine when the machine is operating and the cord or cable connected.

These objects and others which will become more apparent hereinafter will be attained in an electrically powered machine, especially a hand-held power tool, comprising a housing, a disconnectable cord to supply electrical energy having an attached socket, a switch position in the housing changable between an "on" and "off" position, a switch handle mounted on the housing connected mechanically with the switch for operating the switch to change the switch between the "on" and "off" position to control delivery of the electrical energy and a socket mechanism, the socket mechanism comprising the socket attached to the cord and a plug attached rigidly with the housing, the plug being connected electrically with the switch.

According to our invention the machine further comprises a stop pawl connected mechanically with the switch handle so as to be positionable outside the housing in the vicinity of the plug to block connection of the socket with the plug, when the socket is not connected with said plug and when and as long as the switch is in the "on" position.

When the safety device according to our invention is part of a hand-held power tool with a separate power cord and socket the desirable assembly and distribution features of this kind of power tool can be realized while maintaining a satisfactory level of operator safety. With the structure according to our invention, the operator cannot connect the socket to the plug if the switch is in the "on" position.

Separable power cords of different lengths offer a comparatively greater flexibility for the user. A damaged cable or cord can be replaced in seconds rapidly by the user. Bringing the entire machine to the repair shop for that is not necessary.

Several embodiments of our invention are possible. It is particularly advantageous when the switch and the plug are part of a one-piece switch unit. This not only simplifies the construction of the stop pawl, but saves conductors in the interior of the machine, especially, when still other structural parts (e.g. anti-interference means) are integrated in the power tool housing.

Although there are many possible embodiments of our invention corresponding to particular structures in which the objects of our invention are realized in a particularly advantageous embodiment an at least partially elastic lever is mounted in the housing and held between two compression springs in a central position.

One of the compression springs may be braced between the switch handle and the lever, while the other may be braced between the housing and the lever. The stop pawl is hook-like, comprises a bent free end portion of the lever and is urged into a space provided for receipt of the socket when the switch is in the "on" position. The stop pawl may be engagable in a suitable opening in the socket to prevent unintended disconnecting of the socket. The stop pawl is operable by a switch handle of the switch, which acts on the lever. The lever is pivotally mounted at one end on a pivot in the housing and on the other end is movable by the switch handle of the switch via one of the compression springs.

BRIEF DESCRIPTION OF THE DRAWING

The objects, features and advantages of our invention will be made more apparent from the following detailed description, reference being made to the accompanying drawing in which.

DETAILED DESCRIPTION OF THE INVENTION

Figure 1:
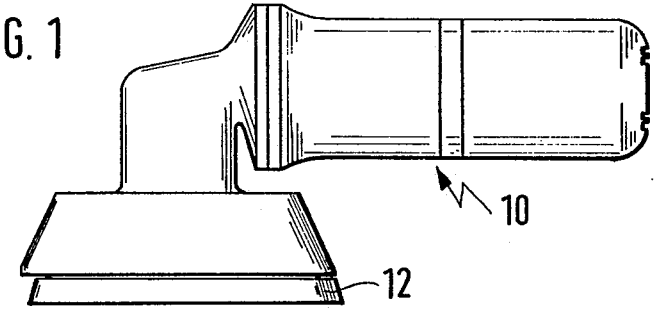
FIG. 1 is a side elevational view of a hand-held power tool according to our invention to which the safety mechanism of the present invention is applicable.
Figure 2:
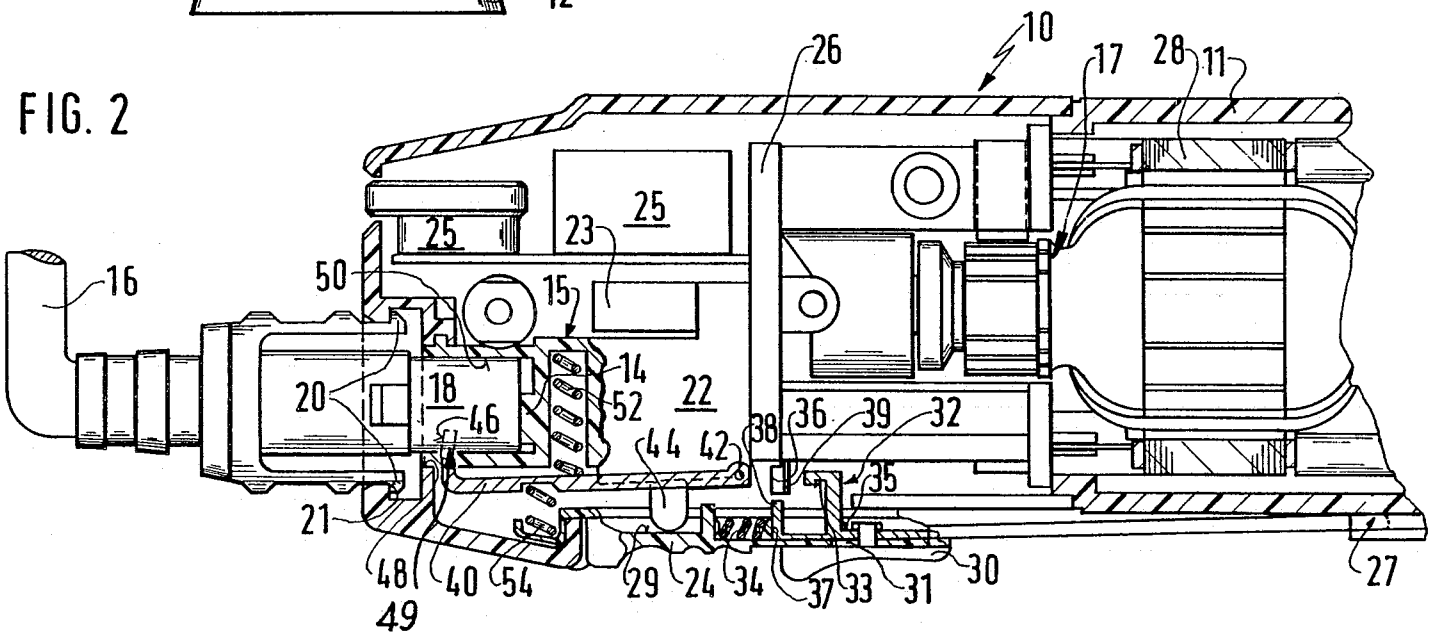
FIG. 2 is a cross sectional view through a hand-held power tool showing the safety mechanism according to our invention.

An angle sander as an example of a hand-held power tool or machine is shown in FIG. 1. The rear portion on the opposite end from the tool 12 is shown in FIG. 2. This type of angle sander is known for example from U.S. Pat. No. 4,434,586. However the invention is usable in all hand-held power tools with energy being fed over a cable or power cord, i.e. for all electrically powered line-supplied hand tools.

The hand-held power tool 10 has a plug 14 built into the housing 11 of the hand-held power tool, to which a socket 18 attached to a power cord 16 is connected. The power cord 16 is not permanently nonreleasably attached to the power tool 10 and is connectable to the hand tool 10 only by the socket 18 as shown in FIG. 2. Spring retaining clips 20, which cooperate with corresponding recesses 21 in the housing 11 of the hand-held power tool, are cast or molded on socket 18 as a safety device preventing unintended removal of the socket from the plug 14.

The plug 14 is connected electrically with a switch 22, which feeds electrical energy to electric motor 17 to drive the sanding tool 12 of the angle sander, in a switch unit 15. The switch 22 is controlled by a switch handle 24 to be described in more detail below, which is mounted for easy gripping on the outer surface of the housing 11 of the hand-held power tool 10.

The switch unit 15 is attached to a connector member 26, which is connected in a known way with the pole piece of the stator 28 of the motor 17 and and carries the commutator brushes of the motor 17. An anti-interference condenser 23 is mounted directly on the switch unit 15, advantageously with a plug-socket connection. In the same way electronic components 25 may be mounted on the switch unit 15 or, as illustrated, on the connector member 26.

The switch handle 24 is inserted with its end 27 functioning as a pivot point in a slot or recess in the housing 11 of the hand-held power tool 10; spaced from the end 27 the switch handle 24 has a sliding push button member or slider 30 carries a push button member 24 on the outside, which is connected with a lock member 32 extending through a slot 31 in the switch handle 24. The lock member 32 has two legs 35 and 37 standing at right angles to the motion direction of a sliding push button member 30, of which the leg 35 on the right in the drawing is longer than the left leg 37 and has a hook 33. A stop stud 36—in the embodiment with the connector member 26—is positioned opposite the lock member 32. The stop stud 36 is in the form of a four cornered eye in whose opening 39 the hook 33 engages and can be locked in.

The lock member 32 is slidable with the sliding push button member 30 against the restoring force of a compressible spring 34 toward the switch handle 24 along the slot 31. In the condition not acted on by manual forces the sliding push button member 30 is pressed to the right by the compressible spring 34, which engages on the lock member 32 and braces itself on the switch handle 24.

The switch handle 24 has a surface 29, which acts on a switch pin 44 of the switch 22, on the side facing the housing interior; it is connected moreover by a compressible spring 54 with a lever 40. This latter lever is mounted pivotable on the switch 22 about an pivot 42 in this embodiment. The lever 40 has an opening for a switch pin 44 of the switch 22 and extends with its free end which is bent like a hook in the vicinity of the plug 14. The hook-like free end portion of the lever 40 functioning as a stop pawl 46 is insertable through an opening in a side wall of the plug 14 in front of the opening 48. With the switch handle 24 not depressed the lever 40 is held by two compression springs 52 and 54 in the central position shown in the drawing. The one compression spring 52 engages in the side of the lever 40 facing away from the switch handle 24 and is supported in the housing of the hand-held power tool 10. The other compression spring 54 is supported on the switch handle 24 and engages on the other side of the lever 40.

The operation of the previously described parts of the invention are described as follows:

The switch handle 24 can be depressed only with the sliding push button member 30 pushed to the left in the drawing for protection against unintended activation. A contacting surface 38 formed on the free end of the left leg 37 of the lock member 32 prevents the pressing in of the switch handle 24 with the sliding push button member 30, since it contacts on the stop stud 36.

On pressing the switch handle 24 and simultaneously sliding the sliding push button member 30 in the drawing to the left, the eye-shaped stop stud 36 cooperating with the lock member 32 engages the hook 33 of the lock member 32 and thus the switch handle 24 is kept in the pressed in position.

When no socket is connected to the plug 14 and the switch handle 24 is pressed in, the bent end of the lever 40 acting as a stop pawl 46 projects laterally through the opening 48 in the space 50 receiving the socket 18 as is indicated in the drawing. In this condition it is not possible to connect the socket 18 to the plug 14.

The depressed state of the switch handle 24 is released by applying a new pressure to it; the compression spring 34 pushes the lock member 32 to the right in the drawing and releases the lock stud 36 from the hook 33. Now it is possible to connect the hand-held power tool to the line current supply. When the socket 18 is connected to the plug 14, the stop pawl 46 is urged toward the outer surface of the socket 18 by action of the compression spring 54. The compression spring 52 acts as a restoring spring here. However, the use of an elastic lever 40 allows one or even both compression springs 52 and/or 54 used in this embodiment to be left out of the apparatus.

It is also possible to engage the stop pawl 46 in a suitable recess or cavity 49 in the outer surface of the socket 18 with the compression spring 54 omitted. In this embodiment then the retaining clips 20 are obsolete because the lock stud 46 can then fulfill a twin function as a switch-on safety device for the hand-held power tool and a pull-out safety device for the socket 18.

It is also conceivable to provide a lever braced on the socket and to design the apparatus so that the switch may be switched to the "on" position or locked in only after the socket has been plugged in.

Also the use of this safety device is not limited to the combination with the illustrated switching characteristics. The locking switch illustrated here could also be a simple key, a dead man switch, a two handle switch or some other suitable type of switch. However, in each case it is possible to provide a locking mechanism to be operated or activated unconsciously to prevent an unintended activation of the machine, as has already been required by law in Scandanavia.

It will be understood that each of the elements described above, or two or more together, may also find a useful application in other types of constructions differing from the types described above.

While the invention has been illustrated and described as embodied in an electrical connection between a circuit board and a hybrid circuit structure and process for making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is desired to be protected by Letters Patent is set forth in the appended claims.

What is claimed is:

1. In an electrically powered machine, especially a hand-held power tool, comprising a housing, a cord to supply electrical energy and having an attached socket, a switch positioned in said housing and changable between an "on" and an "off" position, a switch handle mounted on said housing and connected mechanically with said switch for operating said switch to change said switch between said "on" and "off" position to control delivery of said electrical energy, and a socket mechanism, said socket mechanism comprising said attached socket attached to said cord and a plug attached rigidly with said housing, said plug being connected electrically with said switch, the improvement comprising a stop pawl connected mechanically with said switch handle so as to be positionable outside said housing in the vicinity of said plug to block connection of said socket with said plug, when said socket is not connected with said plug and when and as long as said switch is in said "on" position, whereby said machine is not inadvertently turn on when said cord is connected to said machine.

2. The improvement defined in claim 1, further comprising a spring-loaded lever mounted pivotably on a pivot in said housing and connected and controlled with said switch handle, said stop pawl being part of said lever and said lever being held in a central position with said stop pawl not blocking connection of said socket and said plug, when said switch is in said "off" position, and said lever being movable from said central position, when said socket is not connected with said plug and when said switch handle is operated to put said switch in said "on" position.

3. The improvement defined in claim 2, wherein said lever is bent and has a hook-like free end portion and said stop pawl is said hook-like free end portion of said lever.

4. The improvement defined in claim 2, further comprising two compression springs mounted in said housing, said lever being held resiliently between said springs in said central position, one of said springs having one end braced on said housing and the other end braced on said lever and the other of said springs having one end supported on said switch handle and the other end braced on said lever, and one of said springs being held between said switch handle and said lever so that said lever is pivotable when said switch handle is operated via action of said one of said springs.

5. The improvement defined in claim 1, wherein said socket has an outer surface with an opening and said stop pawl engages in said opening in said outer surface, whereby said socket is held connected to said plug preventing inadvertent separation of said socket from said plug.

6. The improvement defined in claim 2, wherein said lever is elastic.

7. The improvement defined in claim 1, further comprising a spring-loaded exterior sliding push button member slidable in a slot provided in said switch handle and a lock member having two legs substantially at right angles to said switch handle, said lock member being substantially interior to said switch handle, one of said legs having a hook on its free end, and a stop stud shaped like a four-cornered eye in which said hook is engagable on sliding said push button member to lock said switch into said "on" position.

8. The improvement defined in claim 1, further comprising a switch unit containing said plug and said switch.

9. The improvement defined in claim 8, further comprising an anti-interference condenser connected with said switch and said plug.

10. The improvement defined in claim 8, further comprising a connector member mounted in said housing and connected electrically with said switch unit.

11. The improvement defined in claim 1, further comprising a connector member mounted in said housing and connected electrically with said switch.

* * * * *